United States Patent [19]

Petiteau

[11] 4,154,169

[45] May 15, 1979

[54] SAFETY DEVICE FOR A PYROTECHNIC ASSEMBLY

[75] Inventor: Maurice R. Petiteau, Besancon, France

[73] Assignee: Societe Anonyme Sormel, Besancon, France

[21] Appl. No.: 842,227

[22] Filed: Oct. 14, 1977

[30] Foreign Application Priority Data

Nov. 5, 1976 [FR] France ..... 76 33418
Sep. 8, 1977 [FR] France ..... 77 27174

[51] Int. Cl.[2] ..... F42C 9/02
[52] U.S. Cl. ..... 102/233; 102/238; 102/255
[58] Field of Search ..... 102/233, 232, 238, 235, 102/255

[56] References Cited

U.S. PATENT DOCUMENTS

| | | | |
|---|---|---|---|
| 3,115,094 | 12/1963 | Simmen | 102/255 |
| 3,465,676 | 9/1969 | Simmen | 102/233 |
| 3,777,666 | 12/1973 | Morel | 102/233 |
| 3,972,290 | 8/1976 | Czajkowski | 102/238 |

FOREIGN PATENT DOCUMENTS

| | | | |
|---|---|---|---|
| 1198840 | 6/1959 | France | 102/255 |
| 353285 | 5/1961 | Switzerland | 102/255 |

*Primary Examiner*—David H. Brown
*Attorney, Agent, or Firm*—Merriam, Marshall & Bicknell

[57] ABSTRACT

The invention relates to a safety device for a pyrotechnic assembly in a projectile, comprising a fire-screening flap disposed between an ignition primer and explosives, said flap being mounted so as to be escapable under the action of a mechanism provided with a regulator, said regulator being mounted on said flap itself.

10 Claims, 11 Drawing Figures fig: 1
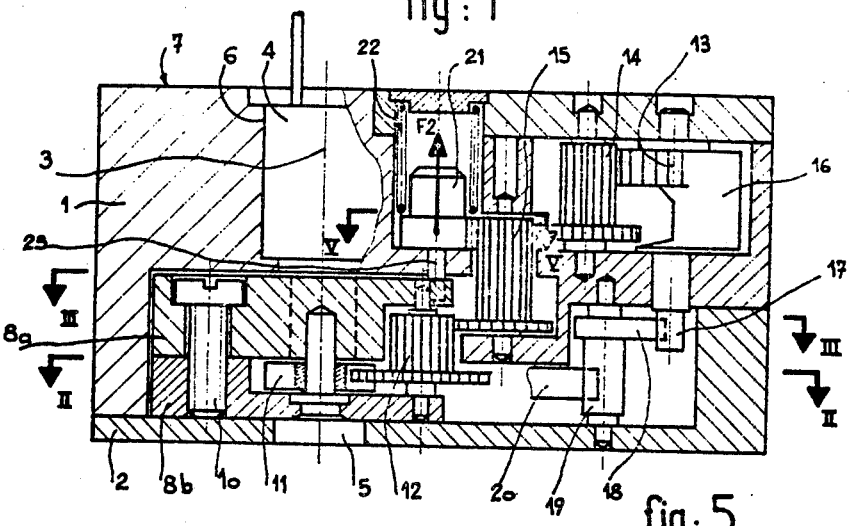
fig: 5
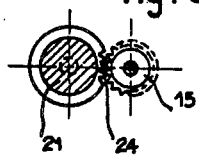
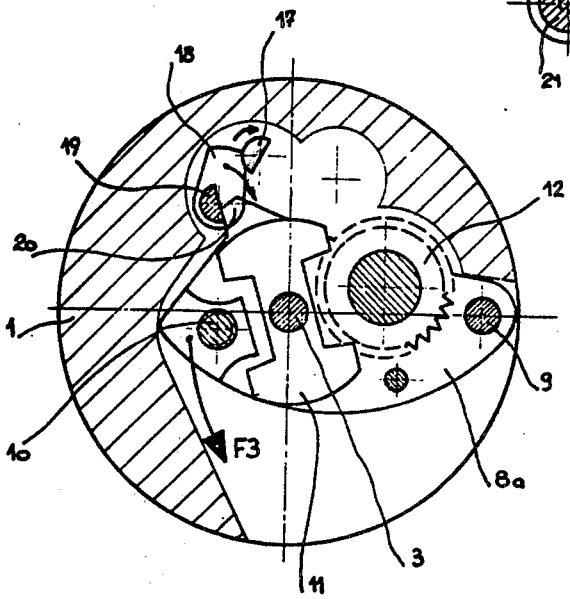
fig: 2

SAFETY DEVICE FOR A PYROTECHNIC ASSEMBLY

The present invention relates to a safety device for a pyrotechnic assembly.

Safety devices are already known which comprise a fire-screening flap disposed in a pyrotechnic assembly between the ignition primer and the secondary detonation primer explosives. Such devices are used in artillery projectiles or in missiles. The fire-screening flap is generally a thick metallic element whose disengagement, i.e. whose putting aside from the pyrotechnic channel is controlled by an outside force, for example a clockwork mechanism enabling the moment of the explosion to be chosen.

These known safety devices comprise three main members, namely the ignition primer, the screening flap and the regulator system(anchor) of the clockwork system. In the case of a spinning projectile, for obvious reasons of good functioning, the axis of this regulator system must necessarily merge with the axis of rotation of the protectile. Consequantly, in the known safety devices of the type mentioned hereinabove, the ignition primer, the screening flap and the anchor are disposed behind one another along the axis of rotation of the projectile. This results in the dimensions of the safety device being large along this axis and the length and shape of the ignition channel being disturbed by the relative position of the primer.

If the screening flap is located between the primer and the anchor or if the anchor is disposed between the primer and the screening flap, the fire must pass through the anchor to reach the secondary explosives from the primer.

If the primer is placed between the anchor and the flap, the connections of said primer with the exterior are difficult to effect. In the case of an electrical connection by wire or pin, it is necessary that these members pass close to the regulator, whilst in the case of a transmission of fire by pyrotechnic means upstream, the anchor and its support form a screen which is as much a hindrance as the first arrangement mentioned.

It is an object of the present invention to remedy these drawbacks, by proposing a safety device of the type described hereinabove, which, whilst being of small dimensions, so as to be able to be mounted in small-calibre ammunition, avoids the above-mentioned drawbacks of the known devices.

To this end, according to the invention, the safety device for a pyrotechnic assembly comprising a fire screening flap disposed between an ignition primer and explosives, said flap being mounted to be escapable under the action of a mechanism provided with a regulator, is noteworthy in that said regulator is mounted on the flap itself.

In this way, due to the invention, a primer-flap-regulator assembly is obtained whose thickness may be limited, since the screening flap also serves as support for the regulator. Moreover, the regulator, instead of being an element which hinders the transmission of fire, becomes a protection element participating in security.

In an advantageous embodiment, the flap is composed of two assembled elements and the regulator is mounted between these two elements.

The flap may be mounted to slide or rotate in order to be able to escape either under the action of the centrifugal force (spinning projectile) or under the action of a spring (non-spinning projectile) when the clockwork mechanism allows it to. Due to the invention, the ignition channel in the axis of the primer may be entirely cleared when the screening flap has escaped.

The safety device and the ignition primer advantageously form a unit which may be disposed in a projectile. This unit comprises a casing closed by a lid, said casing enclosing the primer, the clockwork mechanism and the screening flap provided with the regulator. It also contains various operation-blocking bolts, particularly an inertia bolt.

The inertia bolt advantageously acts in the clockwork mechanism at the location of the regulator.

In this way, the inertia bolt acting on the regulator, i.e. on the downstream end of the linkage formed by the clockwork mechanism, it is possible, before launching the projectile, to tension said clockwork mechanism, i.e. ensure that, despite the clearance which may exist between the different toothed wheels or pinion, each wheel is in abutment by at least one of its cogs, on at least one cog of an adjacent wheel. Due to this initial tensioning of the clockwork mechanism, the functioning of the safety device is ensured a good start and, concomitantly, a precise triggering time of said device is obtained. Moreover, the initial elimination of the clearances, obtained in this way, avoids the deteriorations which the clockwork mechanism might suffer if, with a clearance existing between the wheels, said clearance would be suddenly taken up under the action of the drive wheel, at the moment when the projectile is launched. Such a taking up of clearance by the action of said drive wheel would be the cause of sudden shocks which may deteriorate the wheels and the regulator.

The invention will be more readily understood on reading the following description with reference to the accompanying drawings, in which:

FIG. 1 is a schematic view in developed section of the device according to the invention, for a spinning projectile.

FIGS. 2 and 3 are transverse sections through the device according to the invention taken at elevations through the device corresponding to lines II—II and III—III in FIG. 1 in undeveloped form.

FIG. 5 shows the inertia bolt in detail at an elevation corresponding to line V—V in FIG. 1 in undeveloped form.

Figure 3:
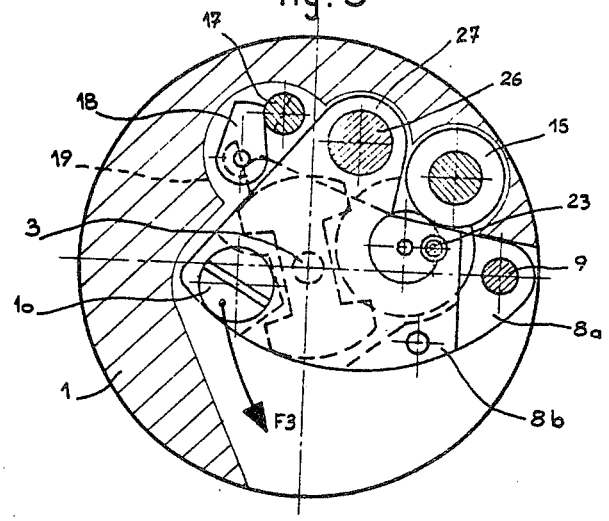

Referring now to the drawings, FIGS. 1 to 5 show the device according to the invention which comprises a cylindrical casing 1 closed by a likewise cylindrical lid 2.

In the axis 3 of the casing 1 and the lid 2 is arranged the ignition channel of the device, defined by an ignition primer 4 and a hole 5 in the lid 2. The primer 4 is housed in a cylindrical housng 6 of the casing, opening in the face 7 thereof opposite the lid 2, so that said primer is accessible from the outside.

Transversely with respect to the ignition channel, between the output of the primer 4 and the hole 5, there is disposed a fire-screening flap 8, mounted to pivot about an eccentric axis 9 (not shown in FIG. 1) parallel to axis 3.

Figure 4:
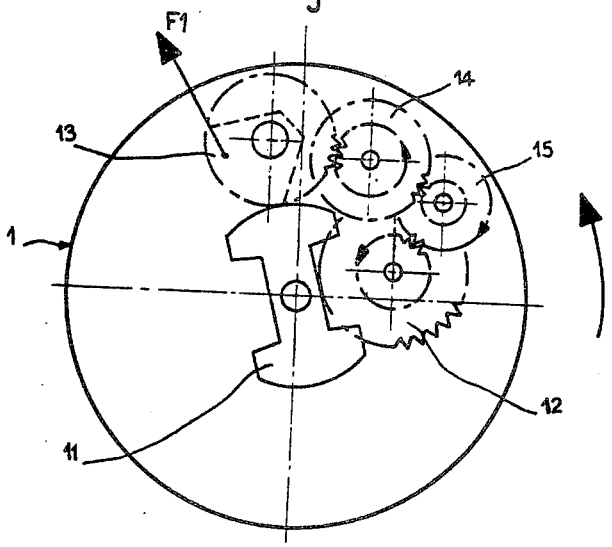
FIG. 4 illustrates the kinematics of the clockwork mechanism of the device of FIGS. 1 to 3.

The fire-screening flap 8 is composed of two flat elements 8*a* and 8*b*, approximately in the form of sectors, assembled together by means of a screw 10. Between the two elements 8*a* and 8*b* of the flap 8 are rotatably mounted an anchor 11 and a pinion 12, in mesh with said anchor. The anchor 11 is centered on the axis 3 and the pinion 12 acts as escape pinion for a clockwork mechanism comprising, moreover, a drive pinion 13, a first intermediate pinion 14 and a second intermediate pinion 15. The axes of the various pinions 12 to 15 are parallel to axis 3. FIG. 4 illustrates the kinematic train formed by these pinions 12 to 15.

The drive pinion 13 comprises an eccentric mass 16 on which is exerted an inertia force F1, when the device is rotated, as it is mounted in a spinning projectile.

The end 17 of the shaft of the drive pinion 13 is half-moon in cross section, cooperating with a rotary cam 18, whose axis is parallel to axis 3. The rotary cam 18 is fast with a likewise half-moon section 19 cooperating with a stop 20 of the fire-screening flap 8.

At rest, the position of the drive pinion 13 is regulated so that, by means of the sections 17, 19 and of the cam 18, the flap 8 is held in fire-screening position.

Furthermore, the device comprises an inertia bolt 21, adapted to slide parallel to the axis 3 under the action of the inertia forces, but pressed by a spring 22. The inertia bolt 21 comprises a member 23 penetrating in a corresponding cavity of the flap 8 to hold it in place and a toothed portion 24, in mesh with the intermediate pinion 15. This toothed portion blocks the rotation of the intermediate pinion 15 (and therefore of the kinematic wheel train 11 to 15), but allows the bolt 21 to slide with respect to the pinion 15, parallel to axis 3.

Consequently, when the device according to the invention is mounted in a spinning projectile so that its axis 3 merges with the axis of rotation of said projectile, the inertia bolt 21, which blocks the wheel train 11 to 15 and the flap 8, is subjected to a force of inertia F2. As long as this force F2 is less than the force exerted by the spring 22, the bolt 21 remains in place, blocking the clockwork mechanism and the flap 8.

As soon as the force of inertia F2 is greater than the force of the spring 22, the bolt 21 compresses said latter and moves, unblocking the clockword mechanism and the flap 8. Consequently, the force F1 exerted on the drive pinion 13 sets the clockwork mechanism in motion. After some time, determined by this mechanism, the rotation of the drive pinion 13 causes the half-moons 17,19 and the cam 18 to rotate and the flap 8 escapes and rotates, about axis 9, in the direction of arrow F3 under the action of the centrifugal force. The ignition channel is then clear and the primer 4 can ignite explosives (not shown) disposed in front of hole 5.

After escape, the flap 8 is applied against the outer edge of the casing. In this position, the flap 8 guides an intermediate explosive charge 25 into the ignition channel to promote the transmission of the fire. The charge 25 is disposed in a hole 26 made in an extension 27 of the element 8*b* of the flap 8.

It will be noted that the pinion 15, in view of the directions of rotation, urges the pinion 12 (fast with the flap 8) in the direction of escape of the flap 8. In fact, the efforts employed are generally largely sufficient for the escape of the flap 8 but, in certain cases, said flap may be in a state of balance and, as there is no interest in providing too great a force of abutment of the projection 20 on the half-moon 19, this extra escape force is very useful for promoting the rotation of the flap 8.

Figure 6:
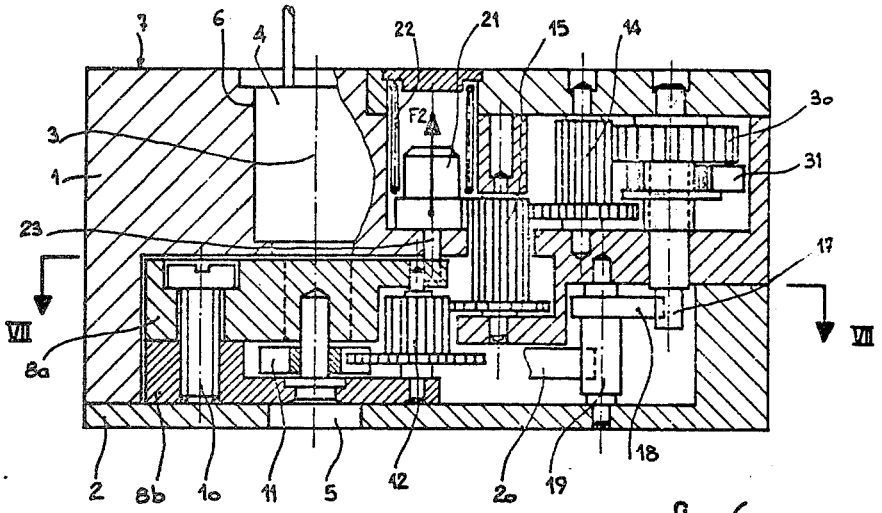
FIG. 6 is a schematic view in developed section of the device according to the invention, for a non-spinning projectile.
Figure 7:
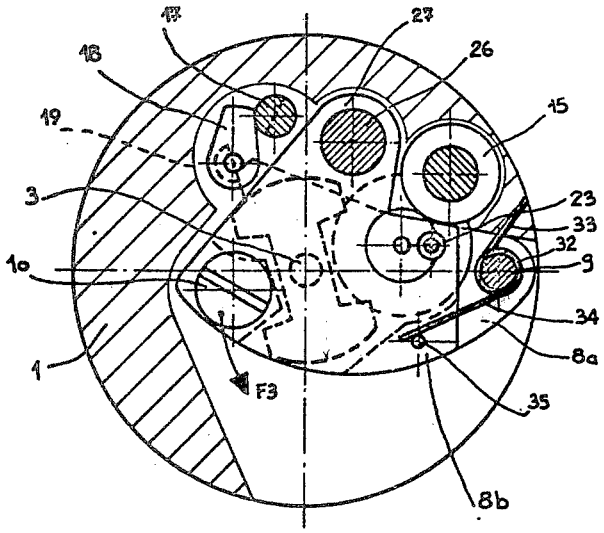
FIG. 7 is a transverse section taken at an elevation corresponding to line VII—VII in FIG. 6 in undeveloped form.

The embodiment described with reference to FIGS. 1 to 5 hereinabove concerns a safety device according to the invention for a projectile spinning about its own axis. The embodiment described hereinafter with reference to FIGS. 6 and 7, corresponding to FIGS. 1 and 3 respectively, is suitable for nonspinning projectiles.

To this end, the drive pinion 13 with eccentric mass 16 is replaced by a drive pinion constituted by a toothed wheel 30, in mesh with the pinion 14 and loaded by spiral spring 31. Moreover, a wire spring 32, wound on the axis 9 of the flap 8, comprises a finger 33 anchored in the casing and a finger 34 tending to repel said flap, by pressing on a stop 35 thereof. In this way, in the absence of centrifugal force, the spiral spring 31 allows the clockwork system to function as soon as the spring 32 allows the flap 8 to escape.

Figure 8:
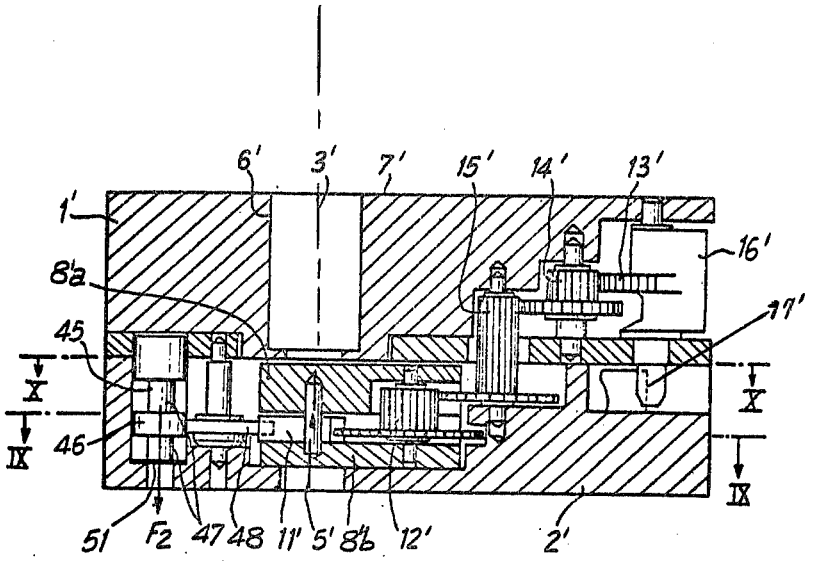
FIG. 8 is a schematic view in developed section of a variant embodiment, for a spinning projectile.
Figure 9:
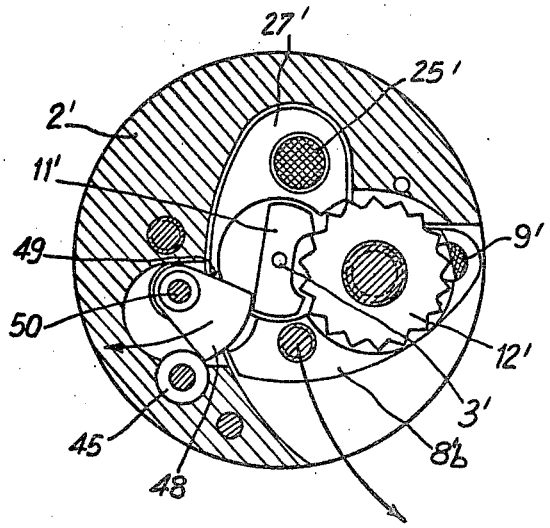
FIGS. 9 and 10 are transverse sections through the device according to the invention taken at elevations corresponding to lines IX—IX and X—X, respectively in FIG. 8 in undeveloped form.
Figure 10:
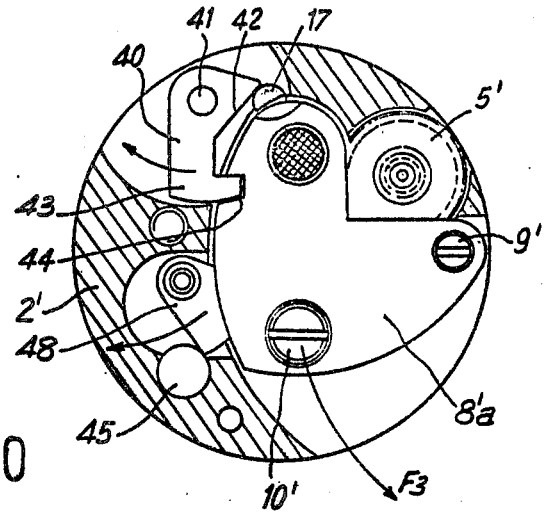
Figure 11:
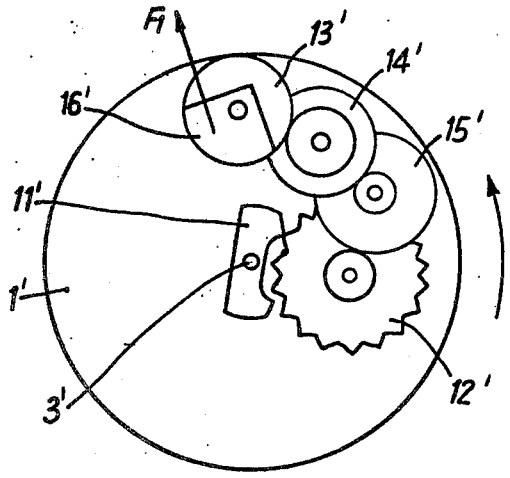
FIG. 11 illustrates the kinematics of the clockwork mechanism of the device of FIGS. 8 to 10.

The variant embodiment shown in FIGS. 8 to 10 comprises elements similar to those of the devices of FIGS. 1 to 7 and like elements bear like references.

The end 17′ of the shaft of the drive pinion 13′ is half-moon in cross-section, cooperating with a pivotal bolt 40, whose axis 41 is parallel to axis 3. The bolt 40 comprises a cam face 42 cooperating with the end 17′ and is in the form of a hook 3 engaged in a recess 44 in the fire-screening flap 8′.

At rest, the position of the drive pinion 13 is regulated to that, by means of the end 17′ and the cam 42, the flap 8′ is held in fire-screening position.

Furthermore, the device comprises an inertia bolt 45, slidable parallel to axis 3, under the action of the inertia forces. In known manner, the inertia bolt 45 may be in the form of a piston with portions 46 and 47 of different diameters and is held in place by a membrane 51. At rest, a large-diameter portion 46 holds a flap 48 in its safety position, on the one hand by blocking the flap and, on the other hand, by immobilising the anchor. This flap 48 is disposed laterally with respect to flap 8′ and penetrates therein through a side opening 49, by pivoting about an axis 50 parallel to axis 3, to block the flap 8′ in fire-screening position and the anchor 11′.

Consequently, when the device according to the invention is mounted in a spinning projectile so that its axis 3 merges with the axis of rotation of said projectile, the inertia bolt 45, which blocks the wheel train 11′ to 15′ and the flap 8′, is subjected to a force of inertia F2. As long as this force F2 is less than the resistance of the membrane 51, the bolt 45 remains in position, blocking the clockwork mechanism and the flap 8′.

As soon as the force of inertia F2 is greater than the resistance of the membrane 51, said latter breaks and the bolt 45 slides so that one of its portions, the small-diameter portion 47, comes opposite the flap 48, which pivots, thus releasing the clockwork mechanism and the fire-screening flap 8. Consequently, the force F1 exerted on the drive pinion 13 sets the clockwork mechanism in motion.

After some time, determined by this mechanism, the rotation of the drive pinion 13′ causes the half-moon 17′ to rotate, the hook 43 moves and the flap 8′ escapes and rotates, about axis 9', in the direction of arrow F3 under the action of the centrifugal force.

It will be noted, as mentioned hereinabove, that, due to the arrangement of the bolt 45 at one end of the wheel train 11' to 15', it is possible normally to maintain this wheel train under tension (by appropriate adjustment in initial rotation), so as to obtain a precise functioning time and to avoid a possible deterioration of this wheel train at the launching of the projectile in the case of a clearance existing between the pinions of said wheel train.

What we claim is:

1. A safety device adapted to be disposed between an ignition primer and an explosive in a pyrotechnic assembly, said device comprising:

a fire-screening flap adapted to escape from a first position in which it blocks an ignition channel between said primer and said explosive and a second position in which said ignition channel is effectively unobstructed by said flap, a clockwork mechanism including a regulator, said clockwork mechanism controlling the escape of said flap from said first to said second position, said regulator being mounted on and movable together with said flap.

2. A device as claimed in claim 1, wherein the flap is composed of two elements assembled together and the regulator is mounted between these two elements.

3. A device as claimed in claim 1, wherein the flap is rotatable.

4. A device as claimed in claim 1, wherein the flap comprises an excrescence provided with a hole filled with explosive, which hole is centered on the ignition channel when the flap is in escaped position.

5. A device as claimed in claim 1 for a non-spinning projectile, wherein the clockwork mechanism comprises a drive pinion loaded by a spring, whilst the flap is also subjected to the action of another spring so as to be escapable under the action of said other spring.

6. A device as claimed in claim 1, wherein said clockwork mechanism includes a pinion mounted on said fire-screening flap and the direction of drive of said pinion by the rest of the clockwork mechanism is such that it promotes the escape of the fire-screening flap.

7. Unit adapted to be arranged in a projectile and comprising a safety device as claimed in claim 1 and an ignition primer, said unit further comprising a casing closed by a lid, said casing enclosing the primer, the clockwork mechanism and the fire-screening flap provided with the regulator, said casing and its lid being cylindrical in form and the flap being mounted to move in a plane at right angles to the axis of the cylinder, whilst the axes of the primer, the different pinions of the clockwork mechanism and the regulator, are parallel to said axis of said cylinder.

8. A device as claimed in claim 1, comprising an inertia bolt locking the clockwork mechanism as well as the fire-screening flap.

9. A device as claimed in claim 8, wherein said inertia bolt acts in the clockwork mechanism at the location of the regulator.

10. A device as claimed in claim 8 further comprising a locking flap, controlled by said inertia bolt and capable of simultaneously locking the regulator and the fire-screening flap.

* * * * *

UNITED STATES PATENT AND TRADEMARK OFFICE

CERTIFICATE OF CORRECTION

PATENT NO. : 4,154,169

DATED : May 15, 1979

INVENTOR(S) : Maurice R. Petiteau

It is certified that error appears in the above-identified patent and that said Letters Patent are hereby corrected as shown below:

Col. 3, line 53, "clockword" should be --clockwork--.

Col. 4, line 33, "3" should be --43--

Col. 4, line 36, "to" should be --so--.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*